United States Patent [19]

Grashof et al.

[11] Patent Number: 4,601,966

[45] Date of Patent: Jul. 22, 1986

[54] DRY, ELECTROGRAPHIC DEVELOPER COMPOSITIONS CONTAINING POLYESTER-AMIDE TONER PARTICLES

[75] Inventors: Hans R. Grashof, Rochester; Hsin-Chia Kan, Fairport; M. Akram Sandhu, Pittsford; John F. Wright, Penfield; Paul D. Yacobucci, Rochester, all of N.Y.

[73] Assignee: Eastman Kodak Company, Rochester, N.Y.

[21] Appl. No.: 688,386

[22] Filed: Jan. 2, 1985

[51] Int. Cl.[4] ..... G03G 9/08

[52] U.S. Cl. ..... 430/109; 430/107

[58] Field of Search ..... 430/109, 106.6, 107

[56] References Cited

U.S. PATENT DOCUMENTS

| | | | |
|---|---|---|---|
| 3,546,178 | 12/1970 | Caldwell et al. | 528/283 |
| 3,764,538 | 10/1973 | Shelffo | 430/109 |
| 3,985,664 | 10/1976 | Sakaguchi et al. | 430/109 |
| 4,078,931 | 8/1974 | Gibson et al. | 430/109 |
| 4,116,943 | 9/1978 | Ducarre | 528/292 |
| 4,134,760 | 8/1974 | Gibson et al. | 430/110 |
| 4,140,644 | 8/1977 | Sandhu et al. | 430/109 |
| 4,254,254 | 3/1981 | Gilkey et al. | 528/288 |

FOREIGN PATENT DOCUMENTS

| | | |
|---|---|---|
| 1062946 | 9/1979 | Canada . |
| 1525937 | 9/1978 | United Kingdom . |
| 1538381 | 1/1979 | United Kingdom . |
| 2003885A | 3/1979 | United Kingdom . |

*Primary Examiner*—John L. Goodrow

*Attorney, Agent, or Firm*—David F. Janci

[57] ABSTRACT

An electrographic, dry two-component developer composition is disclosed comprising triboelectrically charged carrier particles and oppositely charged toner particles. The toner particles contain, as a binder, an amorphous, random polyester-amide containing amide linkages in the polymer backbone and is derived from certain dicarboxylic acids, compounds containing primary amino groups and compounds containing hydroxyl groups. A process for using the developer composition to form toner image copies of an original is also disclosed.

6 Claims, No Drawings

DRY, ELECTROGRAPHIC DEVELOPER COMPOSITIONS CONTAINING POLYESTER-AMIDE TONER PARTICLES

This invention relates to dry electrographic two-component developer compositions containing carrier particles and polyester-amide toner particles. The invention also relates to the use of such compositions in an electrographic copy process.

In an electrographic process of the kind with which the present invention is concerned, an electrostatic latent image is formed, usually by imagewise exposure to light of a uniformly charged photoconductive layer, and this latent image is then developed (i.e., rendered visible) by treatment with a dry developer composition containing electrically charged carrier particles and oppositely charged toner particles. The toner image so produced can be transferred to a receiving sheet, often of plain paper, and then fused to render it permanent.

If the developer composition is to be used for magnetic brush development, the carrier particles are of a magnetic material, such as iron filings, powdered iron or iron oxide. If the composition is to be used for some other development method, such as cascade development, the carrier particles can be of a nonmagnetic substance such as powdered inorganic salt (e.g., sodium or potassium chloride). In either case, the toner and carrier particles are chosen to have the desired triboelectric properties so that they acquire opposite charges on mixing together. In this way, the toner particles obtain their necessary charge and are kept in the developer composition by electrostatic attraction to the carrier particles, before deposition on the latent image.

To function well, toner particles have to satisfy numerous requirements. They need to melt sharply and at a fairly low temperature so that, while desirably not requiring a high temperature for fusing to the support, they do not soften and clump together at temperatures approaching the fusion temperature. They need to have good charge capacity and good triboelectric properties relative to those of the carrier particles so that they are not thrown off the carrier particles by mechanical agitation of the developer composition as occurs, for example, with a rapidly rotating magnetic brush. They need to be tough, so as not to undergo comminution by such agitation, and yet brittle, so as to be readily grindable. They need to retain their cohesive strength at temperatures well above their fusion temperature so that, on separation of a fused image from a hot fusing roller, part of the image is not offset onto that roller with consequent contamination of subsequently fused images.

Various toners have been proposed which satisfy some of these requirements; for example, U.S. Pat. Nos. 4,078,931 and 4,134,760 describe the use in toners of polymers having, as a result of chemical after-treatment, amide functions in side groups which control the triboelectric charging properties; the U.S. Pat. No. 4,140,644 describes the use of certain polyesters to give toner particles with a good "offset latitude", i.e., a substantial difference between the temperature at which fusion starts and the temperature at which the cohesive strength of the particles is reduced sufficiently for offsetting to take place. However, none of these patents describes polymers which optimally satisfy all of the above-described requirements. For example, the polyamide toners of U.S. Pat. Nos. 4,078,931 and 4,134,760, while having good triboelectric properties, tend to be difficult to grind and have rather high fusion temperatures. Likewise, the polyesters of U.S. Pat. No. 4,140,644, while providing improved fusing characteristics, are not easily ground to a particle size of less than 25 μm and exhibit high toner throw-off and poor charging capacity.

Toners in the developer compositions of the present invention exhibit a useful level of and stable triboelectric charge without the use of charge-control agents. At the same time, these toners have good mechanical and thermal characteristics.

In accordance with the invention, a two-component dry electrographic developer composition is provided comprising a plurality of charged carrier particles and a plurality of oppositely charged toner particles. The toner particles in the composition comprise, as a binder, a random and amorphous polyester-amide which has amide linkages in the polymer backbone and is derived from at least 20 mole percent of an aromatic dicarboxylic acid, based on the total carboxylic acid-derived units and either:

(i) a polyfunctional compound containing a primary amino group and an hydroxyl group, or (ii) a polyfunctional compound containing at least two primary amino groups and a polyfunctional compound containing at least two hydroxyl groups, with the proviso that no amino group is bonded directly to an aromatic nucleus.

With respect to the compounds from which the recurring units of the copolymer are derived, for illustration purposes:

(a) the aromatic dicarboxylic acid can be terephthalic acid or isophthalic acid, (b) the polyfunctional compound containing a primary amino group and an hydroxyl group can be hydroxyethoxyethylamine, 6-amino-1-hexanol, 2-amino-2-methyl-1,3-propanediol or 4-(aminomethyl)cyclohexanemethanol, (c) the polyfunctional compound containing at least two primary amino groups can be a diamine of formula $H_2N(CH_2)_rNH_2$, where r is 2 to 11, 1,4-cyclohexanebis(methylamine), or m-xylene-α,α'-diamine, and (d) the polyfunctional compound containing at least two hydroxyl groups can be a compound of formula $HO—(CH_2)_p—OH$ where p is 2 to 10; 2,2-dimethyl-1,3-propanediol; 2-ethyl-2-n-butyl-1,3-propanediol; di(2-hydroxyethyl)ether; 1,4-cyclohexanedimethanol; glycerol; pentaerythritol; or 1,2-propanediol.

Typical polyester-amides have the general formula:

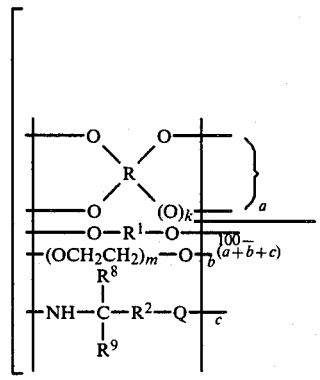

-continued

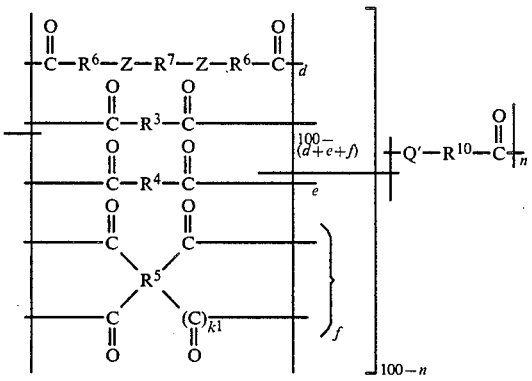

wherein:

each of Q and Q' independently is —O— or —NH—;

Z is —CONH— or —NHCO— wherein N is not directly attached to an aromatic ring;

R is a tri- or tetravalent residue of an alkane or cycloalkane;

$R^1$ and $R^3$, independently, are straight-chain, branched or cyclized alkylene;

$R^2$ and $R^{10}$, independently, are alkylene, cycloalkylene, a divalent aromatic group, or alkylene-(-Q''-alkylene)$_x$ where Q'' is —O— or —NH— and x is 1 to 4, $R^2$ and $R^{10}$ being such that, when Q or Q' is —NH—, the nitrogen atom is not bonded directly to an aromatic nucleus;

$R^4$ is an arylene group;

$R^5$ is a tri or tetravalent residue of an alkane, cycloalkane or aromatic compound;

$R^6$ and $R^7$, independently, are arylene or alkylene;

$R^8$ and $R^9$, independently, are hydrogen, alkyl or —$R^{11}$—Q— wherein $R^{11}$ is alkylene;

a is 0 to 5 mole percent;

b is 0 to 80 mole percent;

c is 0 to 100 mole percent;

d is 0 to 100 mole percent;

e is 20 to 100 mole percent;

f if 0 to 5 mole percent;

each of k and k' is 0 or 1;

m is 2, 3 or 4;

n is 0 to 70 mole percent;

with the proviso that c and d are not both 0, and the mole percentages of a to f, and n are chosen so that 1 to 50 percent, and preferably 10 to 50 percent, of the total number of ester and amide linkages are amide linkages, and the polymer chains optionally are terminated by reaction with a monofunctional compound.

R and $R^1$ in the above formula preferably contain 2 to 10 carbon atoms; $R^2$ preferably contains, excluding any aromatic portion, 0 to 10 carbon atoms; and $R^3$ preferably contains 2 to 16 carbon atoms.

The following are examples of groups R to $R^{11}$ and of monomers which can be used to provide such groups: when k is 0, R, together with the oxygen atoms to which it is connected, can be derived from glycerol; when k is 1, R, together with the oxygen atoms to which it is connected, can be derived from pentaerythritol. Alkylene groups $R^1$, together with the oxygen atoms to which they are connected, can come from linear alkylene glycols of formula HO—$(CH_2)_p$OH where p is from 2 to a preferred maximum of 10, and branched alkylene glycols, e.g., ethylene glycol, 2,2-dimethyl-1,3-propanediol, 1,2-propanediol, and 2-ethyl-2-n-butyl-1,3-propanediol; alkyleneoxyalkylene groups when employed for $R^2$ or $R^{10}$ can come from di(2-hydroxyethyl)ether. When Q is —NH—, the recurring unit represented in the foregoing structure by:

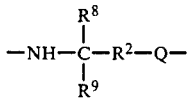

can be derived from diamines such as those of formula $H_2N$—$(CH_2)_r$—$NH_2$ where r is 2 to 11, for example, hexamethylenediamine; 1,4-cyclohexanebis(methylamine) or m-xylene-α,α'-diamine. When Q is 0, this recurring unit can be derived from hydroxyamino compounds such as hydroxyethoxyethylamine, 6-amino-1-hexanol, 2-amino-2-methyl-1,3-propanediol and 4-(aminomethyl)cyclohexanemethanol. $R^2$, $R^8$ and $R^9$ can together give such mixed groups as arylenealkylene (provided Q is —O— or nitrogen atoms are not directly attached to aromatic nuclei) and arylenedialkylene, e.g., phenylenemethylene, phenylenedimethylene and methylenephenylenethylene. Preferred aromatic dicarboxylic acids from which the recurring unit containing $R^4$ can be derived are isophthalic and terephthalic acids ($R^4$=phenylene). Other suitable aromatic acids from which the $R^4$ recurring unit can be derived are 1,4-, 1,5- and 1,7-naphthalenedicarboxylic acids. Examples of acids from which the recurring unit containing $R^3$ can be derived are 1,3-cyclopentanedicarboxylic acid, 1,4-cyclohexanedicarboxylic acid, saturated straight-chain dicarboxylic acids (i.e., $R^3$=(—$CH_2$—)$_q$ such as succinic (q=2), glutaric (q=3) and azelaic (q=7) acids. Examples of other useful polycarboxylic acids which can be employed to form acid-derived recurring units in the above polyesteramide, particularly units containing $R^5$, are trimellitic acid, trimesic acid, pyromellitic acid, mellophanic acid and ethylenediaminetetraacetic acid. Instead of the acid itself, a derivative such as the anhydride or an ester or halide can be used.

Examples of substituents which can be present in any of groups R to $R^{11}$ are halogen atoms, alkoxy groups or nitro groups, i.e., groups not taking part in the condensation reactions leading to formation of the polymer.

A condensation product formed from a dicarboxylic acid and either a diamine or an amino acid can be included in the reaction mixture to provide units which contain amide groups designated by Z, and the residues $R^6$ and $R^7$, together with the linking carbonyl group to which $R^6$ is connected; for example, a low-molecular-weight derivative of hexamethylenediamine and adipic or terephthalic acid can be included in the reaction mixture. Furthermore, as indicated by the general formula, a prepolymer can be prepared from the chosen monomers and the prepolymer reacted with an hydroxy acid (Q'=—O—) such as 4-hydroxybenzoic acid or with an amino acid (Q'=—NH—, provided nitrogen atoms are not directly linked to aromatic groups) to form the recurring unit containing $R^{10}$.

When it is desired to terminate the defined polyesteramide, to slow down the polymerization reaction for an optimum synthetic route or to slow down unwanted reactions of the polymer during use, such as further polymerization induced by heat from the fusing rollers, the polymer can be reacted with a simple monofunctional end-capping compound. Suitable compounds include (1) 3,4-dimethoxybenzoic acid, (2) methoxyacetic acid, (3) methyl p-anisate, (4) methyl p-nitrobenzoate and (5) methyl stearate.

The polyester-amides described herein are amorphous in the sense that they exhibit substantially no crystallinity when evaluated by techniques employed in the determination of the crystallinity of polymers. The glass transition temperature, Tg, of the polymers can vary, depending on the monomer substituents chosen. Preferably, the Tg of the polymer is from about 60° C. to about 120° C.

POLYMER PREPARATION

Polyester-amides described herein can be prepared by conventional condensation polymerization techniques from the chosen carboxyl (or carboxylic ester), hydroxyl and primary amino group-containing monomers. Condensation polymerization techniques are described in, for example, *Polymer Chemistry—An Introduction*, M. P. Stevens, Addison Wesley Publishing Co., Reading, Mass, U.S.A. (1975), and *Preparative Methods of Polymer Chemistry*, W. B. Sorenson and T. W. Campbell, 2nd Ed., Wiley, New York, N.Y., U.S.A. (1968).

Polymers were prepared for use in the following examples from the monomers and in the relative molar proportions shown in Tables 1 to 6 below. The numbers preceding each compound under the table columns —except where specified otherwise, as in the case of prepolymers reacted with hydroxybenzoic acid or aminobenzoic acid—refer to the mole percent of the respective compound based on there being 100 mole percent for the total dicarboxylic acid content, and 100 mole percent for the total diol-, diamino- and hydroxyamino-derived units.

Table 1 (1 through 8) and Table 2 compound 9 show toner comparison binders outside the scope of the invention. These comparison polymers either were polyesters but not polyesteramides (1 through 6) or were polyesteramides in which an amino nitrogen atom is directly linked to an aromatic nucleus (7 and 8). Tables 2 to 6 show toner polymers useful for the invention.

Tables 1 and 4 include polymers 1–8, and 52–56, respectively, prepared by first making a prepolymer and then reacting this with an hydroxy- or aminocarboxylic acid.

In the following tables, EC-(1), EC-(2), EC-(3), EC-(4), EC-(5) and PE refer to, respectively, 3,4-dimethoxybenzoic acid, methoxyacetic acid, methyl p-anisate, methyl p-nitrobenzoate, methyl stearate, and pentaerythritol.

TABLE 1

Polyesters and Polyester-Amides Prepared for Comparison Tests

| Polymer | Dicarboxylic Acid(s) | Dihydroxy Compound(s) | Monomer Reacted with Polyester Prepolymer |
|---|---|---|---|
| 1 | 60 terephthalic<br>40 1,4-cyclohexanedicarboxylic | 100 ethylene glycol | 40 4-hydroxybenzoic acid |
| 2 | as Polymer 1 | 100 ethylene glycol | 50 4-hydroxybenzoic acid |
| 3 | as Polymer 1 | 100 ethylene glycol | 60 4-hydroxybenzoic acid |
| 4 | 100 terephthalic | 40 di-(2-hydroxyethyl) ether;<br>60 2,2-dimethyl-1,3-propanediol | 30 3-hydroxybenzoic acid |
| 5 | 100 terephthalic | as Polymer 4 | 45 3-hydroxybenzoic acid |
| 6 | 100 terephthalic | 20 di-(2-hydroxyethyl) ether;<br>80 2,2-dimethyl-1,3-propanediol | 35 3-aminobenzoic acid |
| 7 | 100 terephthalic | as Polymer 6 | 40 3-aminobenzoic acid |
| 8 | 100 terephthalic | as Polymer 6 | 45 3-aminobenzoic acid |

TABLE 2

Polyester-Amides from Terephthalic Acid (100 mole percent), Hexamethylene Diamine and Various Hydroxylic Compounds

| Polymer | Hexamethylenediamine | Di-(2-hydroxy-ethyl)ether | 2,2-Dimethyl-1,3-propanediol | Ethylene glycol | 1,4-Cyclohex-anedimethanol | Pentaerythritol |
|---|---|---|---|---|---|---|
| 9 | — | 10 | 87.5 | — | — | 2.5 |
| 10 | 2 | 10 | 85.5 | — | — | 2.5 |
| 11 | 5 | 10 | 82.5 | — | — | 2.5 |
| 12 | 20 | — | 80 | — | — | — |
| 13 | 20 | — | 77.5 | — | — | 2.5 |
| 14 | 20 | 10 | 70 | — | — | — |
| 15 | 20 | 10 | 67.5 | — | — | 2.5 |
| 16 | 20 | 20 | 60 | — | — | — |
| 17 | 20 | 20 | 57.5 | — | — | 2.5 |
| 18 | 10 | 30 | 57.5 | — | — | 2.5 |
| 19 | 20 | 30 | 47.5 | — | — | 2.5 |
| 20 | 10 | 10 | 77.5 | — | — | 2.5 |
| 21 | 15 | 10 | 72.5 | — | — | 2.5 |
| 22 | 20 | — | 50 | — | 30 | — |
| 23 | 10 | — | — | 57.5 | 30 | 2.5 |
| 24 | 20 | — | — | 57.5 | 20 | 2.5 |
| 25 | 20 | — | — | 47.5 | 30 | 2.5 |
| 26* | 20 | — | 77.5 | — | — | 2.5 |

*Acid component 90 mole % terephthalic acid, 10 mole % glutaric acid

TABLE 3

Polyester-Amides from Isophthalic Acid (100 mole percent), Hexamethylenediamine and Hydroxylic Compounds

| Polymer | Hexamethylenediamine | 2,2-Dimethyl-1,3-propanediol | Pentaerythritol | Other Di-Hydroxy Compounds |
|---|---|---|---|---|
| 27 | 20 | — | — | 80 1,4-cyclohexanedimethanol |

TABLE 3-continued

| Polymer | Polyester-Amides from Isophthalic Acid (100 mole percent), Hexamethylenediamine and Hydroxylic Compounds | | | |
|---|---|---|---|---|
| | Hexamethylenediamine | 2,2-Dimethyl-1,3-propanediol | Pentaerythritol | Other Di-Hydroxy Compounds |
| 28* | 10 | — | 2.5 | 87.5 1,4-cyclohexanedimethanol |
| 29 | 30 | — | — | 70 1,4-cyclohexanedimethanol |
| 30 | 20 | 79.5 | 0.5 | — |
| 31 | 20 | 79 | 1.0 | — |
| 32 | 20 | 78 | 2.0 | — |
| 33** | 20 | 77.5 | 2.5 | — |
| 34 | 5 | 92.5 | 2.5 | — |
| 35 | 10 | 87.5 | 2.5 | — |
| 36 | 30 | 67.5 | 2.5 | — |
| 37 | 15 | 80 | 5 | — |
| 38 | 5 | 95 | — | — |
| 39 | 20 | 80 | — | — |
| 40 | 10 | 90 | — | — |
| 41 | 25 | — | 2.5 | 72.5 ethylene glycol |
| 42 | 30 | — | 2.5 | 67.5 ethylene glycol |
| 43 | 20 | — | — | 80 ethylene glycol |
| 44 | 20 | — | — | 80 tetramethylene glycol |
| 45 | 20 | — | — | 80 pentamethylene glycol |

*end-capped with EC-(5)
**end-capped with EC-(1)(33), EC-(2)(33a), EC-(3)(33b) or EC-(4)(33c)

TABLE 4

| Polymer | Polyester-Amides of Terephthalic Acid (Mole Percent = 100 Minus Azelaic Acid Content), 4-(Aminomethyl)cyclohexanemethanol and Other Monomers | | | |
|---|---|---|---|---|
| | Azelaic Acid | 4-(Aminomethyl)cyclo-hexanemethanol | Other Hydroxy Compound | 4-Hydroxybenzoic Acid Reacted with Prepolymer |
| 46 | 0 | 100 | 0 | 0 |
| 47 | 20 | 100 | 0 | 0 |
| 48 | 30 | 100 | 0 | 0 |
| 49 | 40 | 100 | 0 | 0 |
| 50 | 50 | 100 | 0 | 0 |
| 51 | 60 | 100 | 0 | 0 |
| 52 | 60 | 100 | 0 | 40** |
| 53 | 60 | 100 | 0 | 60** |
| 54 | 70 | 100 | 0 | 40** |
| 55 | 70 | 100 | 0 | 60** |
| 56 | 70 | 100 | 0 | 70** |
| 57 | 0 | 50 | 50 2-ethyl-2-n-butyl-1,3-propanediol | 0 |
| 58 | 0 | 10 | 90 2,2-dimethyl-1,3-propanediol | 0 |
| 59 | 0 | 20 | 80 2,2-dimethyl-1,3-propanediol | 0 |
| 60* | 0 | 40 | 57.5 2,2-dimethyl-1,3-propanediol + 2.5 PE | 0 |

*end-capped with EC-(5)
**Mole percent based on the total moles of prepolymer and 4-hydroxybenzoic acid

TABLE 5

| Polymer | Polyester-Amides of Isophthalic Acid (100 mole percent), 4-(Aminomethyl)cyclohexanemethanol and Other Monomers | | |
|---|---|---|---|
| | 4-(Aminomethyl)cyclohexanemethanol | 2,2-Dimethyl-1,3-propanediol | Other Hydroxy and Acid Monomers |
| 61 | 20 | 80 | — |
| 62 | 10 | 90 | — |
| 63 | 5 | 95 | — |
| 64 | 15 | 82.5 | 2.5 pentaerythritol |
| 65 | 20 | 77.5 | 2.5 pentarythritol |
| 66 | 30 | 67.5 | 2.5 pentaerythritol |
| 67 | 40 | 57.5 | 2.5 pentaerythritol |
| 68 | 50 | 50 | — |
| 69 | 40 | 60 | — |
| 70 | 25 | 75 | — |
| 71 | 30 | 70 | — |
| 72 | 20 | 77 | 3 glycerol |
| 73 | 20 | 0 | 80 1,4-cyclohexanedi-methanol |
| 74 | 20 | 77.5 | 2.5 pentaerythritol + 10 glutaric acid |
| 75 | 20 | 77.5 | 2.5 pentaerythritol + 5 glutaric acid |

TABLE 6

| Polyester-Amides of Iso- or Tere-phthalic Acid and Various Hydroxyl and/or Amino Monomers | | | | |
|---|---|---|---|---|
| Polymer | Phthalic Acid | Additional Acid | Amino Monomer | Hydroxy Monomers |
| 76 | tere- | — | 20 m-xylene-α,α'-diamine | 80 2,2-dimethyl-1,3-propanediol |
| 77 | tere- | — | 20 m-xylene-α,α'-diamine | 80 1,2-propanediol |
| 78 | iso- | — | 20 m-xylene-α,α'-diamine | 80 1,4-cyclohexanedimethanol |
| 79 | iso- | — | 20 m-xylene-α,α'-diamine | 80 2,2-dimethyl-1,3-propanediol |
| 80 | iso- | — | 40 m-xylene-α,α'-diamine | 60 2,2-dimethyl-1,3-propanediol |
| 81 | 80 iso- | 20 glutaric | 20 m-xylene-α,α'-diamine | 77.5 2,2-dimethyl-1,3-propanediol + 2.5 PE |
| 82 | 80 iso- | 20 glutaric | 20 m-xylene-α,α'-diamine | 80 2,2-dimethyl-1,3-propanediol |
| 83 | tere- | — | 20 1,4-cyclohexanebis(methylamine) | 80 2,2-dimethyl-1,3-propanediol |
| 84 | iso- | — | 20 1,4-cyclohexanebis(methylamine) | 80 2,2-dimethyl-1,3-propanediol |
| 85 | iso- | — | 20 1,4-cyclohexanebis(methylamine) | 80 tetramethylenediol |
| 86 | iso- | — | 20 6-amino-1-hexanol | 80 1,4-cyclohexanedimethanol |
| 87 | iso- | — | 20 hydroxyethoxyethylamine | 80 2,2-dimethyl-1,3-propanediol |
| 88 | 50 iso- | 50 succinic | 20 2-amino-2-methyl-1,3-propanediol | 80 2,2-dimethyl-1,3-propanediol |

Toner particles for use in the developer of the invention can have an average diameter between about 0.1 μm and about 100 μm, a value in the range from about 1.0 to about 30 μm being preferable for many currently used machines. However, larger or smaller particles may be needed for particular methods of development or development conditions.

The toner particles can be prepared by any of the known methods. One method is melt-blending involving melting a powdered form of the binder polymer and mixing it with the other chosen addenda which commonly include a colorant such as a dye or pigment. The polymer is melted usually on heated compounding rolls which are also used to mix the polymer and addenda together. After thorough blending, the mixture is cooled and solidified. The resultant solid mass is then broken into small particles and finely ground to form a free-flowing powder of toner particles having the desired size. After this procedure, the toner powder particles usually range in size from about 0.5 to about 25 microns, with an average size of about 2 to about 15 microns.

Although suitable toner materials having the appropriate charging characteristics can be prepared without the use of a colorant material, it is more usual to incorporate a dye or pigment as a colorant. A great many of the colorants mentioned in the *Colour Index*, Volumes 1 and 2, Second Edition, can be used. Representative colorants include Hansa Yellow G (C.I. 11680), Nigrosine Spirit Soluble (C.I. 50415), Chromogen Black ETOO (C.I. 45170), Solvent Black 3 (C.I. 26150), Fuchsine N (C.I. 42510) and C.I. Basic Blue 9 (C.I. 52015). Carbon black is a particularly useful colorant. The amount of colorant needed varies over a wide range, for example, from about 1 to about 20 percent of the weight of the polyester-amide binder. Particularly good results are obtained using from about 1 to about 10 percent by weight.

Additional polymers can be included in the toner particles to form polymer blends with the required polyester-amide. Such additional polymers can be any suitable toner resin including other polyester-amides within the scope of those defined herein. Preferably, blends of polyesteramides are employed.

The present developers contain carrier particles in combination with the defined toner particles. Any suitable material can be employed for the carrier particles whether magnetic or nonmagnetic. Representative nonmagnetic carrier materials include glass beads, crystals of inorganic salts such as sodium or potassium chloride, hard resin particles, and metal particles. Preferably, magnetic materials are employed including ferromagnetic materials such as iron, cobalt, nickel and alloys, and mixtures thereof. Particularly useful magnetic materials comprise hard magnetic materials (i.e., permanently magnetizable) exhibiting (a) a coercivity of at least 300 gauss at magnetic saturation and (b) an induced magnetic moment of at least 20 EMU/gm when in an applied magnetic field of 1000 gauss. Such particularly useful materials are described in International Patent Application No. PCT/US83/01716 entitled Electrographic Developer Composition and Method for Using the Same, published May 10, 1984. Such hard magnetic particles include ferrites and gamma ferric oxide. Preferably, the carrier particles are composed of ferrites, which are compounds of magnetic oxides containing iron as a major metallic component. Most preferred ferrites include compounds of barium and/or strontium, such as $BaFe_{12}O_{19}$ and magnetic ferrites having the formula $MO.6Fe_2O_3$, where M is barium, strontium or lead, as disclosed in U.S. Pat. No. 3,716,630. The diameter of the carrier particles including any resin coating on the carrier can be from about 5 microns to about 1000 microns and preferably is from about 10 microns to about 300 microns.

As noted above, the carrier particles can be overcoated with a thin layer of a film-forming resin for the purpose of establishing the correct triboelectric relationship and charge level with the toner employed. Examples of suitable resins are the polymers described in U.S. Pat. Nos. 3,547,822, 3,632,512, 3,795,618 and 3,898,170 and Belgian Pat. No. 797,132. Other useful resins are fluorocarbons such as polytetrafluoroethylene, poly(vinylidene fluoride), mixtures of these, and copolymers of vinylidene fluoride and tetrafluoroethylene.

Further useful carrier particles are of passivated magnetic stainless steel of at least 9 weight percent chromium content. The particles are passivated by treatment with nitric acid which forms a chromium-rich, stable film on their surfaces. Before passivation the particles can be treated, e.g., with hydrofluoric acid, to remove surface silicon.

The developer of the present invention is formed by mixing the defined carrier particles with toner particles in a suitable concentration. Representative developers contain up to about 50 percent toner, by weight of developer. Preferably, the developers contain from about 70 to 99 weight percent carrier and about 30 to 1 weight percent toner. Most preferably, the concentration of carrier is from about 75 to 99 weight percent and the concentration of toner is from about 25 to 1 weight percent.

Dry developer compositions of the invention are appropriate for developing electrostatic images by any of the usual methods. These include cascading a cascade developer composition across a charge pattern, as described in U.S. Pat. Nos. 2,618,551, 2,618,552 and 2,638,416, and applying toner particles from a developer composition on a magnetic brush, as described in U.S. Pat. No. 3,003,462.

An imagewise distribution of toner particles obtained by developing an electrostatic charge pattern with a developer composition of the invention can be fixed to a support by heating at or above the temperature of onset of fusion. Heating can be carried out with fuser rollers or radiant heat as described in U.S. Pat. Nos. 3,666,247, 3,826,892 and 4,118,178 or by other means such as hot air, microwave radiation or flash heating.

The following examples are included for a further understanding of the invention.

TEST PROCEDURES

In Examples 1–4 below, results are given for a variety of tests on developer compositions of the invention. Details of the test procedures are as follows:

Particle Size:

A known weight of toner is dispersed in filtered water/surfactant and sonified. This sample is further diluted and run through a Hiac PA-720 particle analyzer with a CMH-60 sensor (available from Hiac Royco, Div. of Pacific Scientific, Menlo Park, Calif.) A number and volume median and size-frequency distribution is thus obtained.

Grindability:

The relative grindability was assessed by comparing the particle sizes obtained for the chosen grinding conditions.

Charge per Unit Mass:

The charge of a developer is determined in terms of the polarity and level of charge, in microcoulombs per gram (μcoul/gm), of the toner particles in the developer. The charge polarity of the present developers is preferably positive. The level of charge on the developer can vary depending, for example, on the particular carrier employed as, well as any polymeric coating present on the carrier. The charge level of developers of the invention can be at leat +5 μcoul/gm of toner and is preferably from about +15 to about +35 μcoul/gm of toner. In this regard, charge levels exceeding +100 μcoul/gm of toner have been achieved as determined in accordance with the procedure described below.

A standard weight of a mixture of toner and carrier particles prepared under standard conditions is placed on a screen mesh which closes the end of a tube and allows toner, but not carrier, particles to go through. A standard air flow is then passed through the tube from the toner side of the mesh. Toner particles are removed from the carrier particles, and the voltage due to the resulting charge is measured with an electrometer. Also, the weight of the residual toner is measured so that the charge/mass ratio can be calculated from the relationship:

$$\frac{Q\ (\mu\ \text{coulomb})}{M\ (\text{grams})} = \frac{\text{electrometer voltage (volts)} \times \text{electrometer capacitance } (\mu\ \text{farad})}{\text{weight of toner blown off (grams)}}$$

Throw-off:

A standard weight (30 g) of a mixture of toner and carrier particles prepared in a standard manner is placed in a cut-down lightweight plastic cup vibrated at 480 oscillations/min for 10 min on a mechanical shaker. Toner particles thrown off the carrier particles are collected on a weighed filter paper held just above the top of the cup in a Buchner funnel to which a standard degree of vacuum is applied. The filter paper is reweighed, and the weight of toner particles collected expressed, for convenience, in milligrams in the "throw-off" value. For a toner having the minimum preferred charge/mass ratio of 15 μcoulomb/gram, the throw-off is usually less than 1 mg.

Keep:

A 6-mm-thick layer of toner is kept under a steel weight for 72 hr at 52° C. After cooling, the weight is removed from the toner with a magnet and the degree to which the toner has remained a free-flowing powder is qualitatively assessed on a scale ranging from "excellent" through "good", "fair" and "poor" to "fused".

Offset Latitude:

This is the difference between the offset temperature and the temperature of onset of fusion. These temperatures are measured by passing paper to which toner has been applied mechanically (e.g., with a camel's-hair brush) between an internally heated, compliant fusing roll and a noncompliant pressure roll bearing on the fusing roll at a pressure of 2.63 N/mm (15 lb/in). The temperature of onset of fusion is the roll temperature which fuses the toner to an extent such that, when the paper is folded, a crack less than 0.2 mm wide is produced in the toner. The offset temperature is the roll temperature at which fused toner starts to appear on the roll, as well as on the paper.

EXAMPLE 1

Toner particles were prepared by treating in a heated two-roll rubber mill at approximately 130° C. a mixture of 100 parts by weight of the polymer to be tested and 5 parts by weight of carbon black (Regal 300 TM from Cabot Corp). The composition was cooled and ground to a particle size of 5–30 μm in a fluid energy mill.

The toner particles so obtained were mixed at a concentration of 3 to 4% by weight with carrier particles consisting of oxidized sponge iron powder coated with poly(vinylidene fluoride). The mixing was carried out in a closed container rotated for several minutes on a two-roll mill.

Charge/mass and throw-off values were measured for each toner by the test procedures outlined above, the results being summarized in Table 7 below.

TABLE 7

| Polymer | See Table: | Mole % Diamine | Charge/Mass (M coul/g) | Throw-off (mg) |
|---|---|---|---|---|
| 1 | 1 | 0 | 13.7 | 1.1 |
| 2 | 1 | 0 | 12.4 | 3.4 |
| 3 | 1 | 0 | 20.0 | 0.4 |
| 4 | 1 | 0 | 8.9 | 1.9 |
| 5 | 1 | 0 | 6.8 | 12.8 |
| 6 | 1 | 0 | 10.1 | 32.8 |
| 7 | 1 | 0 | 2.0 | 66.2 |
| 8 | 1 | 0 | 9.2 | 23.4 |
| 9 | 2 | 0 | 16.7 | 16.6 |
| 10 | 2 | 2 | 16.7 | 23.9 |
| 11 | 2 | 5 | 24.1 | 9.9 |
| 20 | 2 | 10 | 44.3 | 0.6 |
| 21 | 2 | 15 | 31.7 | 0.3 |
| 15 | 2 | 20 | 49.3 | <0.1 |

The results obtained with the comparison Polymers 1 to 9 indicate either (a) high variability of data with small differences in monomer concentrations (polymers 1–5 and 9), thus making selection of such polymers for toners having consistent properties difficult, or (b) low charge/mass and high throw-off if the polyester-amide contains a nitrogen atom directly linked to an aromatic group (polymers 6–8). Furthermore, when the diamine content in polymers 10, 11, 15, 20 and 21 is too low, the toner charge/mass and throw-off characteristics may not be optimum. For the polymers evaluated, a diamine content greater than 5% is preferred.

EXAMPLE 2

Developer compositions were prepared by the method described in Example 1 using various polyester-amide polymers as specified for the invention. The charge/mass and throw-off values were measured by the techniques outlined above and are given in Table 8.

TABLE 8

| Polymer | See Table: | Charge/Mass (μ coul/g) | Throw-off (mg) |
|---|---|---|---|
| 29 | 3 | 77.6 | 0 |
| 33 | 3 | 70.3 | 0 |
| 34 | 3 | 75.1 | 0 |
| 43 | 3 | 37.0 | 0.6 |
| 46 | 4 | 54.3 | 0 |
| 48 | 4 | 39.1 | 0 |
| 49 | 4 | 38.1 | 0.1 |
| 50 | 4 | 79.0 | 0.2 |
| 51 | 4 | 43.1 | 0 |
| 53 | 4 | 35.4 | 0.1 |
| 54 | 4 | 33.3 | 0.3 |
| 61 | 5 | 39.7 | 0.1 |
| 71 | 5 | 50.5 | 0.3 |
| 76 | 6 | 28.0 | 0.9 |
| 78 | 6 | 24.3 | 1.2 |
| 81 | 6 | 44.6 | 0.9 |
| 83 | 6 | 63.9 | 0.1 |
| 84 | 6 | 101.4 | 0 |
| 87 | 6 | 23.7 | 0 |
| 88 | 6 | 33.1 | 0.3 |

Polymers giving a charge/mass ratio above the preferred maximum value of 35 μcoul/g can be used without further modification. However, if it is desirable to decrease such charge/mass below 35 μcoul/gm, fillers such as Bentonite clay or Cabosil TM silicon oxide can be incorporated therein. Thus, all the above polymers could be used without addition of a charge-control agent to form a suitably charging toner in the developer composition of the invention.

EXAMPLE 3

Developer compositions as in Example 1 were prepared using the comparison Polymer 9 both with 1 part by weight per 100 parts polymer of Ammonyx 4002 TM (a stearyldimethylbenzylammonium chloride available from Onyx Chem. Co., N.J.) and without a charge-control agent and also the three Polymers 11, 15 and 20, as specified for the present invention. Each composition was tested for charge stability and replenishability by placing in a roll mill and measuring samples for charge/mass after 5 min, 15 min, 1 hr, and 5 hr 55 min. At this last time, all the toner was removed from the carrier and replaced with fresh toner. The replenished developer composition was put back on the roll mill and samples were measured after 5 min (i.e., 6 hr from the start of the testing) and after 20 min. Whereas the comparison Polymer 9 did not provide a stable charge and so could not give satisfactory test results, all the polyester-amides were stable, suffering no degree of charge loss during the measurements which could not be reinstated by replenishment.

EXAMPLE 4

Developer compositions were prepared by the method described in Example 1 using the comparison polyester, Polymer 9, and the polyester-amide, Polymer 15. Both polymers had an inherent viscosity measured at 25° C. at a concentration of 0.25 g polymer/g solution in dichloromethane or tetrahydrofuran of approximately 0.065 Pas. Samples of the polymers were subjected to a number of the tests outlined above and the following results were obtained.

TABLE 9

| | Grindability | |
|---|---|---|
| | Particle Size | |
| Polymer | Number Average | Volume Average |
| 9 | 6.7 | 9.8 |
| 15 | 7.0 | 12.1 |

The grindability of the polyester-amide was, for practical purposes, as good as that of the comparison polyester.

Closely similar results were obtained from the "keep" test, the polyester-amide retaining slightly better flow properties.

TABLE 10

| | Offset Latitude | | |
|---|---|---|---|
| Polymer | Onset Temp (°C.) | Offset Temp (°C.) | Latitude (°C.) |
| 9 | 156 | 218 | 62 |
| 15 | 149 | 204 | 55 |

These results show that the offset latitude of the polyester-amide specified for the invention was satisfactory.

Although the invention has been described in considerable detail with particular reference to certain preferred embodiments thereof, variations and modifications can be effected within the spirit and scope of the invention.

What is claimed is:

1. A two-component dry electrographic developer composition comprising a plurality of charged carrier particles and a plurality of oppositely charged toner particles, said toner particles comprising, as a binder, a random and amorphous polyesteramide having amide linkages in the polymer backbone and derived from at least 20 mole percent of an aromatic dicarboxylic acid, based on the total carboxylic acid-derived units, and either:

(i) a polyfunctional compound containing a primary amino group and a hydroxy group or (ii) a polyfunctional compound containing at least two primary amino groups and a polyfunctional compound containing at least two hydroxy groups, wherein the polyester-amide random copolymer is of the general formula:

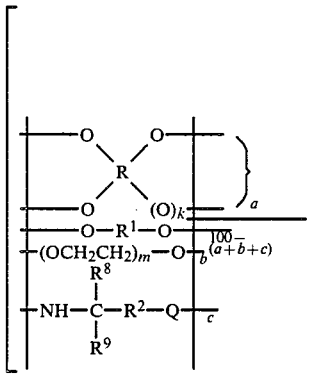

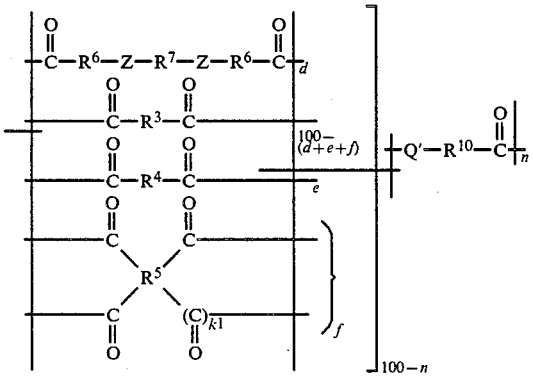

wherein:

each of Q and Q' independently is —O— or —NH—;

Z is —CONH— or —NHCO— wherein N is not directly attached to an aromatic ring;

R is a tri- or tetravalent residue of an alkane or cycloalkane, $R^1$ and $R^3$, independently, are straight-chain, branced or cyclized alkylene;

$R^2$ and $R^{10}$, independently, are alkylene, cycloalkylene, a divalent aromatic group, or alkylene-(1-Q''-alkylene)$_x$ where Q'' is —O— or —NH— and x is 1 to 4, $R^2$ and $R^{10}$ being such that, when Q or Q' is —NH—, the nitrogen atom is not bonded directly to an aromatic ring;

$R^4$ is an arylene group;

$R^5$ is a tri or tetravalent residue of an alkane, cycloalkane or aromatic compound;

$R^6$ and $R^7$, independently, are arylene or alkylene;

$R^8$ and $R^9$, independently, are hydrogen, alkyl or —$R^{11}$—Q— wherein $R^{11}$ alkylene;

a is 0 to 5 mole percent;

b is 0 to 80 mole percent;

c is 0 to 100 mole percent;

d is 0 to 100 mole percent;

e is 20 to 100 mole percent;

f is 0 to 5 mole percent;

k and $k^1$, independently, are 0 or 1;

m is 2, 3 or 4;

n is 0 to 70 mole percent;

with the proviso that c and d are not both 0, and the mole percentages of a to f, and n are chosen so that 1 to about 50 percent of the total number of ester and amide linkages are amide linkages.

2. A developer composition as in claim 1 wherein the mole percentages of a to f, and n are chosen so that about 10 to about 50 percent of the total number of ester and amide linkages are amide linkages.

3. A developer composition according to claim 1 wherein:

(a) said aromatic dicarboxylic acid is terephthalic acid or isophthalic acid, (b) said polyfunctional compound containing a primary amino group and an hydroxyl group is hydroxyethoxyethylamine, 6-amino-1-hexanol, 2-amino-2-methyl-1,3-propanediol or 4-(aminomethyl)cyclohexanemethanol, (c) said polyfunctional compound containing at least two primary amino groups is a diamine of formula $H_2N(CH_2)_r—NH_2$, where r is 2 to 11, 1,4-cyclohexanebis(methylamine) or m-xylene-α,α'-diamine, and (d) said polyfunctional compound containing at least two hydroxyl groups is a compound of formula $HO—(CH_2)_p—OH$ where p is 2 to 10; 2,2-dimethyl-1,3-propanediol; 2-ethyl-2-n-butyl-1,3-propanediol; di-(2-hydroxyethyl)ether; 1,4-cyclohexanedimethanol; glycerol; pentaerythritol; or 1,2-propanediol.

4. A developer composition according to claim 3 which contains, in addition to said aromatic dicarboxylic acid, a dicarboxyclic acid of formula $HOOC—(CH_2)_q—COOH$ where q is 2 to 16.

5. A developer composition according to claim 3 or 5 wherein ends of the polyester-amide copolymer are end-capped by reaction with a monofunctional compound.

6. A developer composition according to claim 5 wherein ends of the polyester-amide copolymer are end-capped by reaction with 3,4-dimethoxybenzoic acid, methoxyacetic acid, methyl p-anisate, methyl p-nitrobenzoate or methyl stearate.

* * * * *